US005968699A

United States Patent [19]

Matsuzaki et al.

[11] Patent Number: 5,968,699

[45] Date of Patent: Oct. 19, 1999

[54] ELECTROPHOTOGRAPHIC CARRIER AND ELECTROPHOTOGRAPHIC DEVELOPER USING SAME

[75] Inventors: Shigeo Matsuzaki; Takashi Arakane; Kazuo Murakata, all of Sodegaura; Susumu Kikuchi, Tokyo, all of Japan

[73] Assignees: Idemitsu Kosan Co., Ltd., Tokyo; Kyocera Corporation, Kyoto, both of Japan

[21] Appl. No.: 08/927,282

[22] Filed: Sep. 11, 1997

[30] Foreign Application Priority Data

| | | | |
|---|---|---|---|
| Sep. 12, 1996 | [JP] | Japan | 8-241918 |
| Sep. 2, 1997 | [JP] | Japan | 9-236762 |

[51] Int. Cl.[6] ..... G03G 9/107; G03G 9/113

[52] U.S. Cl. ..... 430/106.6; 430/108

[58] Field of Search ..... 430/106.6, 108

[56] References Cited

U.S. PATENT DOCUMENTS

| | | | |
|---|---|---|---|
| 3,507,686 | 4/1970 | Hagenbach | 430/108 |
| 5,093,201 | 3/1992 | Ohtani et al. | 430/108 |
| 5,391,451 | 2/1995 | Yoshie et al. | 430/106.6 |
| 5,478,687 | 12/1995 | Ogawa et al. | 430/106.6 |
| 5,709,975 | 1/1998 | Yoerger et al. | 430/108 |

FOREIGN PATENT DOCUMENTS

| | | | |
|---|---|---|---|
| 0 254 436 | 1/1988 | European Pat. Off. . | |
| 0 441 127 | 8/1991 | European Pat. Off. . | |
| 1-204071 | 8/1989 | Japan | 430/108 |
| 3-73966 | 3/1991 | Japan | 430/108 |
| 4-350668 | 12/1992 | Japan | 430/108 |

OTHER PUBLICATIONS

Patent Abstracts of Japan, vol. 14, No. 59 (P–1000), Feb. 2, 1990, JP 01 282564, Nov. 14, 1989.

Patent Abstracts of Japan, vol. 6, No. 258 (P–163), Dec. 17, 1982, JP 57 155552, Sep. 25, 1982.

Derwent Abstracts, AN 90–127008, JP 02 069 770, Mar. 8, 1990.

*Primary Examiner*—Roland Martin

*Attorney, Agent, or Firm*—Oblon, Spivak, McClelland, Maier & Neustadt, P.C.

[57] ABSTRACT

Disclosed is an electrophotographic carrier comprising a magnetic carrier core and a coating layer composed of a high molecular weight polyethylene resin with which the carrier core is coated, wherein the coating layer composed of a high molecular weight polyethylene resin includes a layer containing hydrophobic silica, a magnetic powder, and/or a micropowdered resin at least as the outermost layer.

6 Claims, No Drawings

ELECTROPHOTOGRAPHIC CARRIER AND ELECTROPHOTOGRAPHIC DEVELOPER USING SAME

BACKGROUND OF THE INVENTION

1. Field of the Invention

The present invention relates to an electrophotographic carrier and an electrophotographic developer using the electrophotographic carrier, and, in particular, to an electrophotographic carrier and an electrophotographic developer using the electrophotographic carrier, which are used in an image forming process.

2. Prior Art

In the past, a binary type developing method has been known as one electrostatic latent image developing method used in electrophotography. In the binary type developing method, an insulating non-magnetic toner is mixed with magnetic carrier particles to charge the toner by friction. The resulting developer is then transferred to contact an electrostatic latent image and thereby develop the electrostatic latent image.

The particulate carrier used in such a binary type developing method is generally formed by coating a magnetic carrier core material with an appropriate material with the view of preventing the toner from forming a film on the surface of the carrier, forming a carrier with a uniform surface, prolonging the life of the developer, and controlling damage to a sensitive material by the carrier and the charge amount.

However, conventional carriers have not satisfied the durability requirements since coatings of these tend to be peeled off by the impact caused by agitation and the like during operation.

In order to solve such a problem, the present inventors have developed and proposed a technology for forming a polyolefin type resin coating by polymerizing an olefin type monomer directly on particles of carrier core material such as ferrite or the like (for example, Japanese Patent Application Laid-open No. 187771/1990 and the like). The carrier provided with the polyolefin type resin coating prepared in this manner has excellent characteristics in which the adhesion strength between a core material and a coating is very high and hence the image quality never deteriorates even if the copying operation is continued for a long period of time. Also, the carrier provided with the polyolefin type resin coating has superior durability and spent resistance.

However, on the other hand, this carrier provided with the polyolefin type resin coating has the drawback that the charge polarity, charge amount, and the like can not be optionally controlled and there is no durability to necessarily satisfy resistance to a spent phenomenon caused by adhering of external additives.

In order to solve the above problems, Japanese Patent Application Laid-open No. 100242/1978 discloses a material produced by compounding nigrosine in a carrier coating resin to increase the negative charge and Japanese Patent Application Laid-open No. 9661/1986 discloses the instance in which the fluidity is improved by adding a fluidity improving agent. Also, Japanese Patent Application Laid-open No. 210365/1990 discloses a technology for homogenizing charge properties and preventing a spent phenomenon by adding any one of electroconductive particles, inorganic filling particles, and a charge control agent.

However, these technologies can not satisfy both optional controllability of the charge polarity and charge amount and prevention of a spent phenomenon caused by external additives for a toner while making use of the excellent characteristics of the carrier coated with a polyolefin type resin.

This invention has been achieved in view of this situation and has an object of providing an electrophotographic carrier which can satisfy both optional controllability of the charge polarity and charge amount and effective prevention of the spent phenomenon of external additives, while making use of the high durability of a carrier coated with a polyolefin type resin. The present invention has also an object to provide an electrophotographic developer using such an electrophotographic carrier.

SUMMARY OF THE INVENTION

The above objects can be attained in the present invention by an electrophotographic carrier comprising a magnetic carrier core material and a coating layer composed of a high molecular weight polyethylene resin with which the carrier core material is coated, wherein:

the coating layer composed of a high molecular weight polyethylene resin includes a layer containing hydrophobic silica, magnetic powder, and/or a micropowdered resin at least as the outermost layer.

In preferred embodiments of the present invention, the particle diameter of the above magnetic powder or a micropowdered resin is in a range from 0.1 to 1 $\mu$m; and the resistance of the carrier is in a range from $10^2$ to $10^{14}$ $\Omega\cdot$cm.

Also, the present invention provides an electrophotographic developer comprising the photographic carrier and a toner in an amount of from 2 to 40% by weight to the total amount of the photographic carrier and the toner.

As mentioned above, an electrophotographic carrier can be provided which is excellent in durability and charge capability and in which the charge polarity and the charge amount can be optionally controlled, the fluidity of a developer can be improved and the spent phenomenon due to adhesion of external additives can be effectively prevented. Also, an electrophotographic developer using the electrophotographic carrier can be provided.

DETAILED DESCRIPTION OF THE INVENTION AND PREFERRED EMBODIMENTS

The embodiments of the photographic carrier of the present invention and the photographic developer using the electrophotographic carrier will now be explained in detail.

I. Electrophotographic Carrier

The electrophotographic carrier of the present invention comprises a carrier core and a coating layer composed of a high molecular weight polyethylene resin with which the carrier core is coated, wherein the coating layer composed of a high molecular weight polyethylene resin includes a layer containing hydrophobic silica, magnetic powder, and/or a micropowdered resin at least as the outermost layer.

Each structural element is now explained.

1. Carrier Core (1) Material

There are no limitations to materials used for the carrier core material of the present invention. Materials known as a photographic binary system carrier may be used. Examples of the materials used for the carrier core material include (1) ferrite, magnetite, metals such as iron, nickel, cobalt, and the like; (2) alloys or mixtures of these metals and the like, and metals such as copper, zinc, antimony, aluminum, lead, tin, bismuth, beryllium, manganese, magnesium, selenium, tungsten, zirconium, vanadium, and the like; (3) mixtures of the above ferrite and the like, and a metal oxide such as iron oxide, titanium oxide, magnesium oxide, and the like, a nitride such as chromium nitride, vanadium nitride, and the like, or a carbide such as silicon carbide, tungsten carbide, and the like; (4) ferromagnetic ferrites; and (5) mixtures of these.

(2) Shape and Particle Diameter

There are no limitations to the shape of the particle. Any shape including a spherical shape, undefined, or the like may be acceptable. Also, there are no limitations to the particle diameter. Compounds having a particle diameter of from 20 to 100 $\mu$m are preferably used. If the particle diameter is less than 20 $\mu$m, there is the case where the carrier adheres (scatter) to an electrostatic latent image support material (usually light sensitive material). On the other hand, if the particle diameter exceeds 100 $\mu$m, there is the case where carrier stripes appear and image quality is impaired.

(3) Content of Component

The content of the carrier core material is designed to be 90% by weight or more and preferably 95% or more in the total carrier. The thickness of a resin coating layer of the carrier is indirectly defined by the content of the carrier core material. If the content is 90% by weight or less, there is the case where the coating layer is too thick, whereby the coating layer peels away and the charge amount is increased when applied as a developer in practical use. Therefore, the durability and the charging stability required for the developer can be unsatisfied. Also, the repeatability of fine lines showing an image quality deteriorates and there is the problem of a reduction in image density and the like. There are no limitations to the upper limit to the extent that the coating resin layer can completely cover the entire surface of the carrier core material. The upper limit depends on the properties of the carrier core and the coating method.

(4) Electroconductive Layer

An electroconductive layer may be formed on the carrier core prior to the formation of the high molecular weight polyethylene resin layer.

As the electroconductive layer formed on the carrier core, for example, a material in which electroconductive microparticles are dispersed in a binding resin can be used. The formation of the electroconductive layer contributes to the promotion of development and to the preparation of an image with a high density and a clear contrast. This is because the resistance of the carrier is appropriately decreased in the presence of the electroconductive layer whereby leakage and accumulation of a charge are appropriately balanced.

Examples of the electroconductive microparticles added to the electroconductive layer include carbons such as carbon black, acetylene black, and the like; carbides such as SiC and the like; magnetic powder such as magnetite and the like; $SnO_2$, titan black, and the like. Given as examples of the binding resin of the electroconductive layer are various thermoplastic resins, heat curable resins, and these mixtures such as a polystylene type resin, a poly(metha)acryl type resin, a polyolefin type resin, a polyamide type resin, a polycarbonate type resin, polyether type resin, a polysulfonic acid type resin, a polyester type resin, an epoxy type resin, a polybutyral type resin, an urea type resin, an urethane /urea type resin, a silicon type resin, a teflon type resin, and the like, copolymers, block polymers, graft polymers, and polymer blends, and the like of these resins.

The electroconductive layer can be formed by applying a solution in which the above electroconductive microparticles are dispersed in the above binding resin to the surface of the carrier core material particles by spray coating, dipping, or the like. Also, the electroconductive layer can be produced by melting, kneading, and pulverizing the core material particles, the electroconductive microparticles, and the binding resin. Further, the electroconductive layer can be formed by polymerizing a polymerizable monomer on the surface of the core particle in the presence of the electroconductive microparticles. There are no limitations to the size, the amount, and the like of the above electroconductive microparticles to the extent that the characteristics such as resistance and the like of the carrier of the present invention are satisfied. The electroconductive microparticles may have a particle diameter of such a size that it can be uniformly dispersed in the above resin solution. Specifically, the average particle diameter is from about 0.01 to 2.0 $\mu$m and preferably from about 0.01 to 1.0 $\mu$m. The amount of the electroconductive microparticles is not defined unconditionally depending on the kind thereof and the like. However, the amount of the electroconductive microparticles is from 0.1% by weight to 60% by weight and preferably from 0.1% by weight to 40% by weight to the amount of the binding resin of the electroconductive layer. Especially when the filling ratio of the carrier is as small as 90% by weight and the thickness of the coating layer is comparatively thick, there is the problem that the repeatability of fine lines is impaired if continuous copying of the fine lines is carried out using this carrier. However, such a problem can be solved by adding the above electroconductive microparticles.

Incidentally, carrier core particles on which a functional layer such as an electroconductive layer is formed are also called a "carrier core particles" to the extent that it is not misunderstood.

2. Coating Layer Composed of High Polymer Polyethylene Resin (1) Molecular Weight of a Resin Usually, polyethylene resins having a high molecular weight are simply called "polyethylene". Among these, polyethylene resins having a molecular weight of 10,000 or more in terms of a number average molecular weight or 50,000 or more in terms of the weight average molecular weight are preferable. Generally, polyethylene resins having a number average molecular weight of less than 10,000 are distinguished from the polyethylene resins used in the present invention. Examples of such a resin having a number average molecular weight of less than 10,000 include polyethylene wax (Mitsui High Wax, manufactured by Mitsui Petrochemical Industries, Ltd.), Dialene 30 (manufactured by Mitsubishi Gas Chemical Co., Inc.), Nisseki Lexpole (manufactured by Nippon Oil Co., Ltd.), Sanwax (manufactured by Sanyo Chemical Industries, Ltd.), Polyrets (neutral wax, manufactured by Polymer Co., Ltd.), Neowax (manufactured by Yasuhara Chemical Co., Ltd.), AC polyethylene (manufactured by Allied Chemical Inc.), Eporene(manufacture by Eastman Kodak Co.), Hoechst wax (manufactured by Hoechst Co., Ltd.), A-Wax (manufactured by BASF Co., Ltd.), Polywax (manufactured by Petrolite Co., Ltd.), Escomer (manufactured by Exxon Chemical Co., Ltd.), and the like. Polyethylene wax can be applied by conventional dipping, spraying, or the like if it is dissolved in heated toluene or the like. However, a film formed from the polyethylene wax is peeled off by the shear and the like in a developing apparatus in the long run since the mechanical strength of the film becomes lower.

One or more of functional microparticles such as the above electroconductive microparticles and microparticles having charge controllability as described below may be added to the above coating layer composed of the high molecular weight polyethylene resin.

(2) Method for Forming the Coating Layer

There are no limitations to the method for forming the coating layer. Conventional methods such as a dipping method, fluidized bed method, dry method, spray-dry method, polymerization method, or the like can be used. It is desirable that a polyethylene resin should be applied by the following polymerization method to form a strong resin coating which can be peeled off only with difficulty.

(a) Polymerization Method

The polymerization method is a method in which the surface of the carrier core material is processed using an ethylene polymerizing catalyst to polymerize ethylene directly on the surface and thereby to produce a carrier coated with the polyethylene resin. This polymerization method is described, for example, in Japanese Patent Applications Laid-open No. 106808/1985 and No. 187770/1990. In this method, a product prepared by catalytically treating a carrier core and a highly active catalytic component which contains titanium and/or zirconium and is soluble in a hydrocarbon solvent (for example, hexane, heptane, or the like) and organic aluminum are suspended in the above solvent. An ethylene monomer is added to the suspension and polymerized on the surface of the carrier core material to form a polyethylene resin coating layer. When adding the above microparticles having a charge providing function or electroconductive microparticles, these microparticles may be added in the step of forming the coating layer of the high molecular weight polyethylene resin.

In this method, in which the polyethylene coating layer is formed directly on the surface of the carrier core, the prepared film has excellent strength and durability.

If functional microparticles such as electroconductive microparticles, microparticles having charge controllability, and the like are allowed to be dispersed and to coexist in the polymer system in this manner, the functional microparticles are incorporated into a high molecular weight polyethylene resin coating film when the coating film is grown and formed by polymerization, whereby a high molecular weight polyethylene resin coating film containing the functional microparticles can be formed.

(b) Coating Amount

The high molecular weight polyethylene resin coating is preferably formed so that the proportion of the carrier core microparticles/the high molecular weight polyethylene resin coating is from 99.5/0.5 to 90/10 and more preferably from 99/1 to 95/5.

(c) Addition and Carrying of the Functional Microparticles

One or more of the functional microparticles such as electroconductive microparticles, microparticles having charge controllability, and the like may be added to and carried by the high molecular weight polyethylene resin coating to reform the high molecular weight polyethylene resin coating.

As the electroconductive microparticles added to and carried by the high molecular weight polyethylene resin coating, conventionally known compounds including carbides such as above-mentioned carbides such as carbon black, SiC, or the like; electroconductive magnetic powder such as magnetite; $SnO_2$, titanium black, or the like can be used. It is preferable that the average particle diameter of the electroconductive microparticles should be from 0.01 to 5 $\mu$m.

(3) The Outermost Layer

The coating layer includes a layer containing hydrophobic silica, magnetic powder, and/or a micropowdered resin at least as the outermost layer. Hydrophobic silica is not used singly but magnetic powder, and/or a micropowdered resin are used at the same time to form the outermost layer in order to prevent the spent phenomenon caused by external additives. Specifically, in a structure formed in this manner the electrostatic adhesion of an external additive caused by variations in the charging capabilities of hydrophobic silica and increase in charge can be restrained and the adhesion is ensured. Also, two kinds of microparticle are used whereby the intrusion of an external additive with a size of the order of from 20 to 40 nm can be prevented. If hydrophobic silica is used singly, it causes an increase in resistance and increase in charge, whereby the function as a carrier will be lost.

(a) Hydrophobic Silica

As the hydrophobic silica used in the present invention, silica provided with positive or negative charging capabilities by processing the surface of silica using hydrophobic treatment can be used.

The hydrophobic silica has a primary particle diameter of preferably 40 nm or less and more preferably from 10 to 30 nm. If the particle diameter exceeds 40 nm, gaps between silica particles are large so that unevenness appears on the surface of a carrier.

The amount of the magnetic powder is preferably 50 phr (% by weight of additives to coating resins) or less and more preferably from 20 to 30 phr.

Given as examples of commercially available products of silica with positive charging capability are RA200HS manufactured by Nippon Aerosil Co., Ltd., 2015EP and 2050EP manufactured by Wacker Chemicals Co., Ltd, and the like. Examples of commercially available products of silica with negative charging capability include R812 and RY200 manufactured by Nippon Aerosil Co., Ltd., 2000 and 2000/4 manufactured by Wacker Chemicals Co., Ltd, and the like.

In this case, it is desirable that silica with negative charging capability be added to a positively charged toner and silica with positive charging capability should be added to a negatively charged toner.

(b) Magnetic Powder

As the magnetic powder used in the present invention, for example, magnetite, ferrite, iron powder, and the like are exemplified.

The particle diameter of the magnetic powder is preferably from 0.1 to 1 $\mu$m and more preferably from 0.2 to 0.7 $\mu$m. If the particle diameter of the magnetic powder is 0.1 $\mu$m or less, there is the case where the magnetic powder has no effect as a spacer. On the other hand, if the particle diameter exceeds 1 $\mu$m, there is the case where the magnetic powder cannot be added to the outermost layer. The amount of magnetic powder is preferably 50 phr or less and more preferably from 20 to 30 phr.

The resistance of the magnetic powder is preferably from 1E+7 to 1E+10 Ω·cm and more preferably from 1E+7 to 1E+9 Ω·cm. If the resistance is 1E+7 Ω·cm or less, the magnetic powder merely carries a positive charge and possibly exhibits electroconductivity. If the resistance exceeds 1E+10 Ω·cm, a local charge is generated and there is the case where the function as a magnetic powder cannot be accomplished.

As examples of commercially available products of the magnetic powder, tri-iron tetroxide A and tri-iron tetroxide B manufactured by Mitsui Mining & Smelting Co., Ltd. and the like are given.

(c) Microparticle Resin

The microparticle resins used in the present invention are exemplified by the following negatively chargeable resin (A) and positively chargeable resin (B).

(A) Negatively-Chargeable Resin

Examples of the negatively-chargeable resins include fluorine type resins (such as a vinylidene fluoride resin, an ethylene tetrafluoride resin, an ethylene chloride trifluoride resin, an ethylene tetrafluoride/propylene hexafluoride copolymer resin), a vinyl chloride type resin, and celluloid.

(B) Positively-Chargeable Resin

Examples of the positively-chargeable resins include acrylic resins, polyamide type resins such as nylon-6, nylon-6,6, nylon-1,1, and the like, styrene type resins such as polystyrene, ABS, AS, AAS, and the like, vinylidene chloride resins, polyester type resins such as polyethylene terephthalate, polyethylene naphthalate, polybutylene terephthalate, polyacrylate, polyoxybenzoyl, polycarbonate, and the like, polyether type resins such as polyacetal, polyphenylene ether, and the like, and ethylene type resins such as EVA, EEA, EAA, EMAA, EAAM, EMMA, and the like. The particle diameter of the positively chargeable resin is preferably from 0.1 to 1 μm and more preferably from 0.2 to 0.7 μm. If the diameter is 0.1 μm or less, the formation of the positively-chargeable resin is difficult and a desirable effect can never be expected, whereas if the diameter exceeds 1 μm, it is difficult to add a compound with a diameter such as that of the positively-chargeable resin. The amount of positively-chargeable resin is preferably 50 phr or less and more preferably from 20 to 30 phr.

In this case, it is desirable that a negatively-chargeable resin should be added to a positively-charged toner and a positively chargeable resin should be added to a negatively charged toner.

The outermost layer may include either both of the above magnetic powder and the micropowdered resin or only one of these. Also, the compounds used for the magnetic powder and compounds used for the micropowdered resin may be added either singly or in combinations of two or more respectively.

(d) Layer Thickness

The thickness of the outermost layer is preferably from 0.1 to 6 μm. If the thickness is 0.1 μm or less, there is the case where it causes incomplete coating, whereas if the thickness exceeds 6 μm, there is the case where the outermost layer is peeled away by mechanical impact including external friction and the like.

(e) Method for Forming and Fixing the Outermost Layer

The method for forming and fixing the outermost layer is selected from the following two methods depending on the kind of silica to be used and the properties (particle diameter, solubility in an organic solvent, melting point, hardness, and the like) of the magnetic powder and/or the resin. These methods may be used either singly or in combination.

(i) Fixing by Mechanical Impact

Using a mixer such as a sealed type Henshell mixer (FM 10L-type, manufactured by Mitsui Miike Chemical Machine Co.,) or the like, the carrier core coated with the high molecular weight polyethylene resin is smoothed prior to the addition of micropowdered components. Then, an appropriate amount of micropowdered components such as hydrophobic silica, and the magnetic powder and/or the micropowdered resin are mixed to form the outermost layer. The amount of hydrophobic silica and magnetic powder and/or the micropowdered resin depends on the absolute value of the charge amount to be changed and the stability of an actual printed image. If the surface of the high molecular weight polyethylene resin is not smoothed prior to the addition of micropowdered components, the micropowdered components are collected on concave portions to cause the peeling of a film.

More concretely, after smoothing the surface of the carrier prior to the addition of the micropowdered components, the hydrophobic silica and the magnetic powder and/or the micropowdered resin are generally mixed in a proportion of from 0.1 to 50 phr. However, in the present invention, an appropriate amount of these is in the range of 20 to 30 phr in consideration of the durability, change of the resistance due to the formation of the outermost layer, manufacturing stability, and the like. The treatment using a Henshell mixer is performed at a throughput of from 1 to 5 kg and at such a slow rotation that the hydrophobic silica, the magnetic powder, and the micropowdered resin are never scatterred.

Also, the processing time differs according to the amount of hydrophobic silica and magnetic powder and/or micropowdered resin, the amount of high molecular weight polyethylene to be coated, and the like. In the present invention, however, it is required to continue the operation for 0.5 to 5 hours. In this process for fixing the hydrophobic silica and the magnetic powder and/or the micropowdered resin by mechanical impact, sufficient classification is required since refuses (various micropowders) are generated.

(ii) Thermal Fixation by Heating

A carrier coated with a high molecular weight polyethylene resin, an appropriate amount of hydrophobic silica, and a magnetic powder and/or a micropowdered resin are mixed using an apparatus having heating capabilities such as a thermal sphere forming machine (manufactured by Hosokawa Micron Co., Ltd.) or the like to form an outermost layer. The amount of hydrophobic silica, and a magnetic powder and/or a micropowdered resin added at this time depends on the absolute charge amount to be varied and the stability of the actual printed image.

Specifically, though the amount to be added is generally from 0.1 to 50 phr to the amount of applied polyethylene of the carrier coated with high polymer polyethylene, an amount of 20 to 30 phr is desirable in consideration of durability, change of the resistance associated with the formation of the outermost layer, and manufacturing stability.

It is necessary that hydrophobic silica, and a magnetic powder and/or a micropowdered resin adhere uniformly to the surface of the carrier coated with a high molecular weight polyethylene resin prior to the thermal sphere forming process. Micro powders of hydrophobic silica, and a magnetic powder and/or a micropowdered resin are caused to adhere to the surface of the carrier coated with a high molecular weight polyethylene resin electrostatically and mechanically by a mixing process such as a Henshell mixer treatment (for about one minute) besides a ball mill treatment, V blender treatment, or the like. The carrier coated with a high molecular weight polyethylene resin, to which the micro powders uniformly adhere, is instantly heated to a temperature higher than the melting point of polyethylene and cooled so that the micro powder is fixed to prepare the outermost layer. If the instant heating and cooling treatment are not performed, coagulation caused by fusion of a film occurs. Also, mechanical impact at a temperature higher than the melting point causes the peeling of the film.

3. Electroconductive Characteristics of the Carrier

The resistance of the carrier is preferably in a range from $10^2$ to $10^{14}$ (Ω·cm), though the optimum value of the electroconductivity of the carrier varies according to a developer system using the carrier.

If the resistance is not more than $10^2$ Ω·cm, there is the case where carrier development and fog appear, whereas if the resistance exceeds $10^{14}$ Ω·cm, this sometimes causes deterioration in image quality such as a reduction in image density.

Incidentally, the resistance can be measured by applying a voltage of from 1 to 500 V to the upper and lower electrodes of a carrier layer so formed that it has a receiving area of 5 $cm^2$, a weight of 1 kg, and a thickness of 0.5 cm to measure a current flowing through the bottom of the carrier. The measured current is converted to determine the resistance of the carrier.

Electrophotographic Developer

The electrophotographic developer can be prepared by mixing various toners with the above carrier.

1. Toner

As the toner used in the present invention, toners produced by known methods such as a suspension-polymerization method, a pulverization method, a micro-capsule method, spray-dry method, and a mechanochemical method can be used. Materials which may be added to the toner include at least a binder resin and colorant and, as required, other additives such as a charge control agent, lubricant, offset preventive agent, and fixation improving adjuvant. A magnetic material may be added to form a magnetic toner which has an effect on the improvement in developing characteristics and prevention of inter-scattering of a toner. Also, a fluidizing agent can be externally mixed to improve the fluidity of the toner. Examples of materials used for the binder resin include polystyrene type resins such as polystyrene, styrene/butadiene copolymer, styrene/acrylic copolymer, and the like; polyethylene, ethylene type copolymers such as an ethylene/vinyl acetate copolymer, ethylene/vinyl alcohol copolymer, and the like; epoxy type resins, phenol type resins, acryl phthalate resins, polyamide resins, polyester type resins, and maleic acid resins. Given as examples of materials used for the colorant are known dyes and pigments such as carbon black, phthalocyanine blue, Indanthrene Blue, peacock blue, permanent red, iron oxide red, alizarin lake, chrome green, malachite green lake, methyl violet lake, Hansa Yellow, permanent yellow, and titanium oxide. Examples of materials used as the charge control agent are positive charge control agents such as nigrosine, nigrosine base, triphenylmethane type compounds, polyvinylpyridine, quaternary ammonium salt, and the like; and negative charge control agents such as metal complex salts of alkyl substituted salicylic acid (for example, a chrome complex or zinc complex of di-tert-butylsalicylic acid). Examples of materials used for the lubricant include Teflon, zincstearate, and polyvinylidenecholoride. Given as examples of materials used for the offset preventive agent and fixation improving adjuvant are polyolefin wax of low molecular weight polypropylene or its modification, and the like. As the magnetic material, magnetite, ferrites, iron, nickel, or the like can be used. Also, as the fluidizing agent, silica, titanium oxide, aluminum oxide, or the like can be used.

The average particle diameter of the toner is preferably 20 μm or less and is more preferably from 5 to 15 μm.

2. Mixing Proportion

The mixing proportion of the toner in the present invention is generally from 2 to 40% by weight, preferably from 3 to 30% by weight, and more preferably from 4 to 25% by weight. If the mixing proportion of the toner is less than 2% by weight, there is the case where the charge on the toner is high and hence only an insufficient image density is obtained. On the other hand, if the amount is more than 40% by weight, only an insufficient charge is obtained so that there is the case there the toner is scattered from the developing unit, thereby causing contamination of the inside of the copying machine and the occurrence of toner fog on an image.

3. Application

The developer of the present invention is utilized for a two-component or one-half-component electrophotographic systems such as copying machines (analog, digital, monochromatic, or color), printers (monochromatic or color), faxes, or the like. The developer of the present invention is suitably used for high speed or ultra high speed copying machines or printers, in which a large stress is applied to the developer in the developing unit, among these machines. There are no specific limitations to the image forming method, exposing method, developing method (unit), and various control methods (for example, a method for controlling a toner density in a developing unit and the like). The appropriate resistance, particle diameter, particle diameter distribution, magnetic power, charge, and the like of the carrier and toner may be selected corresponding to the system.

EXAMPLES

The present invention will be explained in more detail by way of examples, which are not intended to be limiting of the present invention.

Production of Carrier (1) Preparation of Catalytic Component Containing Titanium 200 ml of dehydrated n-heptane and 15 g (25 mmol) of magnesium stearate, which was dehydrated in advance at 120° C. under reduced pressure (2 mmHg), were charged in a 500 ml flask, in which the air was charged with argon, and were formed into slurry. After 0.44 g (2.3 mmol) of tetrachloride was added dropwise to the slurry while agitating, heating was started to react the mixture under ref lux for one hour to prepare a viscous transparent solution of a titanium-containing catalyst (active catalyst).

(2) Evaluation of Activity of Titanium-Containing Catalyst 400 ml of dehydrated hexane, 0.8 mmol of triethylaluminum, 0.8 mmol of diethylaluminum chloride, 0.004 mmol (as a titanium atom) of the above titanium-containing catalyst prepared in the above (1) were charged in a 1 l autoclave in which the air was replaced with argon and the temperature was raised to 90° C. At this time, the system pressure was 1.5 $kg/cm^2G$. Then, hydrogen was supplied to the system to raise the pressure to 5.5 $kg/cm^2G$ and ethylene was continuously supplied so that the total pressure was maintained at 9.5 $kg/cm^2G$. Under the these conditions, the mixture was polymerized to produce 70 g of a polymer. The polymerization activity was 365 kg/g. Ti/Hr and the MFR (the Melting Flow ate of the polymer at 190° C. and a weight of 2.16 kg according to JIS K 7210) of the obtained polymer was 40.

(3) Production of Carrier Coated with Polyethylene 960 g of sintered ferrite powder F-300 (average particle diameter of 50 μm, manufactured by Powder Tech Co. Ltd.) was charged in a 2 l autoclave, heated to 80° C., and dried under reduced pressure (10 mmHg) for one hour. Then, the mixture was cooled to 40° C., 800 ml of dehydrated hexane was added and agitation was started. Next, 5.0 mmol of diethylaluminum chloride and 0.05 mmol (as a titanium atom) of the above titanium-containing catalyst prepared in the above (1) were added and the mixture was reacted for 30 minutes. Then, the temperature was raised to 90° C., and 4 g of ethylene was supplied. At this time, the system pressure was 3.0 kg/cm$^2$G. Then, hydrogen was supplied to the system to raise the pressure to 3.2 kg/cm$^2$G and 5.0 mmol of triethylaluminum was added to start polymerization. As a result, the pressure in the system decreased to 2.3 kg/cm$^2$G and was stabilized. Then, 5.5 g of carbon black (MA-100, manufactured by Mitsubishi Chemical Co., Inc.), which was formed into a slurry by adding 100 ml of dehydrated hexane thereto, was added and the resultant mixture was polymerized for 45 minutes (supply of ethylene was stopped when the amount of ethylene supplied to the system was reached 40 g), while ethylene was continuously supplied so that the system pressure was maintained at 4.3 kg/cm$^2$G to prepare ferrite coated with a carbon black-containing polyethylene resin in an amount of 1005.5 g as powder. The powder, which was dried, exhibited a uniform black appearance. It was confirmed by an electron microscope that the surface of the ferrite was coated with a thin film of polyethylene and carbon black was uniformly dispersed into the polyethylene film. This composition was subjected to measurement using TGA (thermobalance) and, as a result, the each proportion of ferrite, carbon black, and polyethylene was found to be 95.5:0.5:4.0 (by weight).

The carrier in this intermediate step resulting from the above steps was called "carrier $A_1$". The weight average molecular weight of applied polyethylene, which was measured using GPC, was 206,000.

Next, the carrier $A_1$ was classified by a 125 $\mu$m screen to remove particles having a diameter of 125 $\mu$m or more. The carrier after classification was placed in a fluidized-bed type air flow classifier with a tower diameter of 14 cm, air heated to 115° C. was introduced into the classifier so that the air flow linear velocity in the classifier body was 20 (cm/s), and the carrier was fluidized to obtain another carrier. This carrier was called "carrier $A_2$".

Example 1

1,000 g of the carrier $A_2$ was placed in a Henshell mixer with a volume of 10 l (FM10L type, manufactured by Mitsui Miike Kakoki Ltd.) and agitated for one hour so that it was mechanically impacted whereby its surface was smoothed. Then, 12 g of hydrophobic silica (R812, manufactured by Nippon Aerosil Co., Ltd.) was mixed with the carrier $A_2$. The mixture was agitated for one hour by a Henshell mixer so that it was mechanically impacted. 8 g of magnetic powder (tri-iron tetraoxide A, manufactured by Mitsui Mining & Smelting Co.,Ltd.) was further added and the resultant mixture was agitated for one hour by a Henshell mixer so that it was mechanically impacted to form the outermost layer mixed with silica and a magnetic powder. A carrier with a large diameter, coagulated silica, and coagulated magnetic powder were removed by sieve classification for the purpose of eliminating excesses of silica and magnetic powder existing free without being fixed. Also, the resultant product was processed using a fluidized-bed type air flow classifier at an air flow linear velocity of 20 (cm/s) for two hours for the purpose of eliminating micropowder of silica and the like, which were not fixed, to obtain a carrier B.

Example 2

A carrier C was prepared in the same manner as in Example 1 except that the hydrophobic silica was altered from R812 to RA200HS (both manufactured by Nippon Aerosil Co., Ltd.).

Example 3

A carrier D was prepared in the same manner as in Example 2 except that 12 g of a micropowdered resin (MP2701, manufactured by Soken Kagaku Co., Ltd.) was used instead of 8 g of magnetic powder to form the outermost layer.

Example 4

1,000 g of the carrier $A_2$ was placed in a Henshell mixer with a volume of 10 l (FM10L type, manufactured by Mitsui Miuke Kakoki Ltd.). 12 g of hydrophobic silica (R812, manufactured by Nippon Aerosil Co., Ltd.) and 8 g of a micropowdered resin (MP2701, manufactured by Soken Kagaku Co., Ltd.) were mixed and agitated for one minute, whereby these were caused to adhere to the surface of the carrier $A_2$ electrostatically and mechanically. Then, the mixture was heat-treated with heating air with a temperature of 200° C. using a thermal sphere forming machine (Thermal Sphere Forming Machine, manufactured by Hosokawa Micron Co., Ltd.) to fix silica and the micropowdered resin into the melted coating polyethylene resin layer, whereby the outermost layer mixed with silica and a resin was formed. A carrier with a large diameter, coagulated silica, and coagulated resin were removed by sieve classification for the purpose of eliminating excesses of silica and resins existing free without being fixed. Also, the resultant product was processed using a fluidized-bed type air flow classifier at an air flow linear velocity of 20 (cm/s) for two hours for the purpose of eliminating micropowder of silica and the like, which were not fixed, to obtain a carrier E.

Example 5

A carrier F was prepared in the same manner as in Example 4 except that 12 g of magnetic powder (tri-iron tetraoxide B, manufactured by Mitsui Mining & Smelting Co.,Ltd.) was used instead of 8 g of micropowdered resin.

Comparative Example 1

Non-treated carrier $A_2$ was prepared in the manufacturing example of a carrier.

Comparative Example 2

A carrier G was prepared in the same manner as in Example 1 except that magnetic powder was not used.

Comparative Example 3

A carrier H was prepared in the same manner as in Example 1 except that hydrophobic silica was not used and the amount of magnetic powder was changed from 8 g to 12 g.

Comparative Example 4

A carrier I was prepared in the same manner as in Example 4 except that hydrophobic silica was not used.

Comparative Example 5

1,000 g of the carrier $A_2$ was charged in a Henshell mixer with a volume of 10 l (FM10L type, manufactured by Mitsui Miike Kakoki Ltd.) and agitated for one hour so that it was mechanically impacted whereby its surface was smoothed. Then, 12 g of hydrophobic silica (R812, manufactured by Nippon Aerosil Co., Ltd.) was mixed with the carrier $A_2$. The mixture was agitated for one hour by a Henshell mixer so that it was mechanically impacted. 12 g of magnetic powder (DFC450, manufactured by Dowa Magnetic Powder Co., Ltd.) was further added and the resultant mixture was agitated for one hour by a Henshell mixer so that it was mechanically impacted in an effort to form the outermost layer mixed with silica and a magnetic powder. However, because the particle diameter of the magnetic powder was as large as 20 $\mu$m, the magnetic powder was not fixed and the magnetic powder pulverized by the Henshell mixer remained free.

Comparative Example 6

1,000 g of the carrier $A_2$ was charged in a Henshell mixer with a volume of 10 l (FM10L type, manufactured by Mitsui Miike Kakoki Ltd.) and agitated for one hour so that it was mechanically impacted whereby its surface was smoothed. Then, 12 g of hydrophobic silica (RA200HS, manufactured by Nippon Aerosil Co., Ltd.) was mixed with the carrier $A_2$. The mixture was agitated for one hour by a Henshell mixer so that it was mechanically impacted. 8 g of a resin (MP1400, manufactured by Soken Kagaku Co., Ltd.) was further added and the resulting mixture was agitated for one hour by a Henshell mixer so that it was mechanically impacted in an effort to form the outermost layer mixed with silica and a resin. However, because the particle diameter of the resin was as large as 1.5 $\mu$m, the resin was not fixed, but coagulated and separated in the Henshell mixer so that the outermost layer was not formed.

Comparative Example 7

1,000 g of the carrier $A_2$ was charged in a Henshell mixer with a volume of 10 l (FM10L type, manufactured by Mitsui Miike Kakoki Ltd.) and agitated for one hour so that it was mechanically impacted whereby its surface was smoothed. Then, 22 g of hydrophobic silica (R812, manufactured by Nippon Aerosil Co., Ltd.) was mixed with the carrier $A_2$. The mixture was agitated for one hour by a Henshell mixer so that it was mechanically impacted. 8 g of magnetic powder (triiron tetraoxide A, manufactured by Mitsui Mining & Smelting Co.,Ltd.) was further added and the resultant mixture was agitated for one hour by a Henshell mixer so that it was mechanically impacted to form the outermost layer mixed with silica and magnetic powder. A carrier with a large diameter, coagulated silica, and coagulated magnetic powders were removed by sieve classification for the purpose of eliminating excesses of silica and magnetic powders existing free without being fixed. Also, the resultant product was processed using a fluidized-bed type air flow classifier at an air flow linear velocity of 20 (cm/s) for two hours for the purpose of eliminating micropowder of silica and the like, which were not fixed, to obtain a carrier J. This carrier J was observed using an electron microscope and, as a result, a good deal of silica remaining free without being fixed to the surface was observed. The carrier J was mixed with a toner to form a developer and, as a result, it was observed that silica which had existed on the surface was transferred to the toner.

Comparative Example 8

1,000 g of the carrier $A_2$ was charged in a Henshell mixer with a volume of 10 l (FM10L type, manufactured by Mitsui Miike Kakoki Ltd.) and agitated for one hour so that it was mechanically impacted whereby its surface was smoothed. Then, 12 g of hydrophobic silica (R812, manufactured by Nippon Aerosil Co., Ltd.) was mixed with the carrier $A_2$. The mixture was agitated for one hour by a Henshell mixer so that it was mechanically impacted. 22 g of magnetic powder (tri-iron tetraoxide B, manufactured by Mitsui Mining & Smelting Co.,Ltd.) was further added and the resultant mixture was agitated for one hour by a Henshell mixer so that it was mechanically impacted to form the outermost layer mixed with silica and magnetic powder. A carrier with a large diameter, coagulated silica, and coagulated magnetic powder were removed by sieve classification for the purpose of eliminating excesses of silica and magnetic powder existing free without being fixed. Also, the resultant product was processed using a fluidized-bed type air flow classifier at an air flow linear velocity of 20 (cm/s) for two hours for the purpose of eliminating micropowders of silica and the like, which were not fixed, to obtain a carrier K. This carrier K was observed using an electron microscope and, as a result, a good deal of magnetic powder remaining free without being fixed to the surface was observed. The carrier K was mixed with a toner to form a developer and, as a result, it was observed that magnetic powder which had existed on the surface was transferred to the toner.

Comparative Example 9

1,000 g of the carrier $A_2$ was charged in a Henshell mixer with a volume of 10 l (FM10L type, manufactured by Mitsui Miike Kakoki Ltd.) and agitated for one hour so that it was mechanically impacted whereby its surface was smoothed. Then, 12 g of hydrophobic silica (R805, manufactured by Nippon Aerosil Co., Ltd.) was mixed with the carrier $A_2$. The mixture was agitated for one hour by a Henshell mixer so that it was mechanically impacted. 22 g of micropowdered resin (VT100, manufactured by Daikin Industries, Ltd.) was further added and the resulting mixture was agitated for one hour by a Henshell mixer so that it was mechanically impacted to form the outermost layer mixed with silica and a resin. A carrier with a large diameter, coagulated silica, and coagulated resin powders were removed by sieve classification for the purpose of eliminating excesses of silica and resin powders existing free without being fixed. Also, the resultant product was processed using a fluidized-bed type air flow classifier at an air flow linear velocity of 20 (cm/s) for two hours for the purpose of eliminating micropowders of silica and the like, which were not fixed, to obtain a carrier L. This carrier L was observed using an electron microscope and, as a result, a good deal of the resin coagulated on the surface was observed. The carrier L was mixed with a toner to form a developer and, as a result, it was observed that the coagulated resin which had existed on the surface was transferred to the toner.

Application Example 1

The actual printing endurance of each of the carrier $A_2$ and the carriers B-L prepared in the preparative Example of a carrier, Examples 1–5, and Comparative Examples 1–9, was evaluated using toners A and B. The evaluation of actual printing endurance was performed using a modification of an Ecosis 3550 (manufacture by Kyocera Corporation). In the modification, a material formed of amorphous silicon was used as a sensitive member when evaluating a positively chargeable toner whereas a material formed of an organic electron photographic sensitive member was used when evaluating a negatively chargeable toner. Also, the machine was modified so as to control the surface potential of the sensitive member and the magnet roller bias potential. The results of evaluation of actual printing endurance are shown in Table 1.

The following materials were used as the toners A and B.

| Toner A: | |
|---|---|
| Composition | Parts by weight |
| Styrene-n-butyl methacrylate copolymer | 100 |
| Carbon black (MA#8, manufactured by Mitsubishi Chemical Co., Inc.) | 5 |
| Dye (N07, manufactured by Orient Chemical Industries, Ltd.) | 5 |

The above components were sufficiently mixed using a ball mill and kneaded using a three roll mill heated to 140° C. After the mixture was allowed to stand until it was cooled it was roughly milled using a feather mill and further pulverized using a jet mill to prepare a toner A.

| Toner B: | |
|---|---|
| Composition | Parts by weight |
| Bisphenol A type polyester resin | 100 |
| Carbon black (BPL, manufactured by Cabot Co., Ltd.) | 8 |
| Dye (E-84, manufactured by Orient Chemical Industries, Ltd.) | 5 |

The above components were sufficiently mixed using a ball mill and kneaded using a three roll mill heated to 140° C. After the mixture was allowed to stand until it was cooled, it was roughly milled using a feather mill and further pulverized using a jet mill to prepare a toner B.

The fog on the back ground at the primary stage and after a 10,000 copy test was visually observed to evaluate actual printing endurance and, at the same time, the amount of charge was measured using a charge measuring device (TB-200 type, manufactured by Toshiba Chemical Co., Ltd.). The measurement was performed using the method in which 0.5 g of a toner and 9.5 g of a carrier were mixed, charged in a 50 ml polybottle, and agitated for on hour under the conditions of a blowing pressure of 0.8 kg/cm$^2$ and a blowing time of 50 seconds using a 500 mesh stainless wire gauge.

Application Example 2

The fluidity of each of the carrier $A_2$ and Carriers B to L before and after coating was compared. The fluidity was measured according to JIS Z-2502. The results are shown in Table 2.

INDUSTRIAL APPLICABILITY OF THE INVENTION

As is clear from the above explanations, the electrophotographic carrier of the present invention can be suitably used for developing an electrostatic latent image, for example, utilizing a two-component developing method. Also, the electrophotographic developer of the present invention can be suitable used for an electrophotographic system such as a copying machine, a printer, or a facsimile machine.

TABLE 1

| | Charge amount | | | Evaluation of printing endurance | | | |
|---|---|---|---|---|---|---|---|
| | | | | Primary stage | | After 10000 copies | |
| Carriers | Toner A (μC/g) | Toner B (μC/g) | Toners | Charge (μC/g) | Fog | Charge (μC/g) | Fog |
| Carrier $A_2$ | +11.2 | −13.5 | Toner A | +11.2 | ◎ | +4.5 | X |
| Carrier B | +18.7 | −6.6 | Toner A | +18.7 | ◎ | +17.6 | ◎ |
| Carrier C | +7.7 | −15.6 | Toner B | −15.6 | ◎ | −14.8 | ◎ |
| Carrier D | +2.3 | −27.8 | Toner B | −27.8 | ◎ | −25.5 | ◎ |
| Carrier E | +14.3 | −9.7 | Toner A | +14.3 | ◎ | +8.5 | ○ |
| Carrier F | +16.5 | −10.0 | Toner A | +16.5 | ◎ | +9.8 | ○ |
| Carrier G | +20.4 | −7.2 | Toner A | +20.4 | ◎ | +2.3 | X |
| Carrier H | +4.2 | −5.0 | Toner B | −5.0 | X | −1.7 | X |
| Carrier I | +5.5 | −23.2 | Toner B | −23.2 | ◎ | −4.5 | X |
| Carrier J | +10.3 | −8.4 | Toner A | +10.3 | ○ | +2.2 | X |
| Carrier K | +7.6 | −9.2 | Toner A | +7.5 | X | +1.6 | X |
| Carrier L | +6.8 | −10.6 | Toner A | +6.8 | X | +2.3 | X |

* Evaluation of the fog
◎: No fog, good
○: Not conspicuous, no problem in practice
X: Conspicuous, exhibiting problem in practice

TABLE 2

| Carriers | Fluidity | Carriers | Fluidity |
|---|---|---|---|
| Carrier A | 29.8 s/50 g | Carrier G | 23.3 s/50 g |
| Carrier B | 23.2 s/50 g | Carrier H | 26.4 s/50 g |
| Carrier C | 23.4 s/50 g | Carrier I | 27.0 s/50 g |
| Carrier D | 23.8 s/50 g | Carrier J | 22.8 s/50 g |
| Carrier E | 24.6 s/50 g | Carrier K | 25.3 s/50 g |
| Carrier F | 24.3 s/50 g | Carrier L | 26.2 s/50 g |

What is claimed is:

1. An electrophotographic carrier comprising a magnetic carrier core and a coating layer composed of a high molecular weight polyethylene resin with which the carrier core is coated, wherein:

the coating layer composed of a high molecular weight polyethylene resin includes a layer containing (1) hydrophobic silica, and (2) a magnetic powder, and/or a micropowdered resin, at least as the outermost layer.

2. The electrophotographic carrier according to claim 1, wherein the particle diameter of the magnetic powder and/or micropowdered resin are in a range of from 0.1 to 1 μm.

3. The electrophotographic carrier according to claim 1 or claim 2, wherein the resistance of the carrier is in a range of from $10^2$ to $10^{14}$ Ω·cm.

4. An electrophotographic developer comprising any one of the photographic carriers as claimed in claims 1 to 3 and a toner in an amount of from 2 to 40% by weight of the total amount of the photographic carrier and the toner.

5. The electrophotographic carrier according to claim 1, wherein the hydrophobic silica has a primary particle diameter of 40 nm or less.

6. The electrophotographic carrier according to claim 1, which is obtained by coating said high molecular weight polyethylene resin on said carrier core, smoothing the coated carrier core, and then coating said outermost layer.

* * * * *